United States Patent [19]

Smart et al.

[11] 4,291,883

[45] Sep. 29, 1981

[54] ADJUSTABLE PUTTER BLADE SIGHT

[76] Inventors: Isaac W. Smart; Ethel D. Smart, both of Cass City, Mich.

[21] Appl. No.: 157,664

[22] Filed: Jun. 9, 1980

[51] Int. Cl.[3] ..... A63B 53/00

[52] U.S. Cl. ..... 273/163 R; 273/183 D

[58] Field of Search ..... 273/163 R, 163 A, 164, 273/183 D, 194 A, 162 R

[56] References Cited

U.S. PATENT DOCUMENTS

| | | | |
|---|---|---|---|
| 3,199,873 | 8/1965 | Surratt | 273/163 R |
| 3,273,893 | 9/1966 | Duncan | 273/163 A |
| 3,292,928 | 12/1966 | Billen | 273/163 R |
| 3,667,761 | 6/1972 | Palotsee | 273/194 A |

*Primary Examiner*—George J. Marlo

[57] ABSTRACT

This device is attachable to a golf club, so as to enable a golfer to sight more accurately on the hole, in which he or she wants to place a golf ball, and it consists primarily of a plate with a removable sight rod, which is secured to the top of the putter blade. It further includes a multiple number of recesses in the plate, which are spaced in degrees of angle, for setting the angle of the rod to any desired position by a spring-urged ball in the pivotal portion of the sight rod.

2 Claims, 3 Drawing Figures

FIG. 1
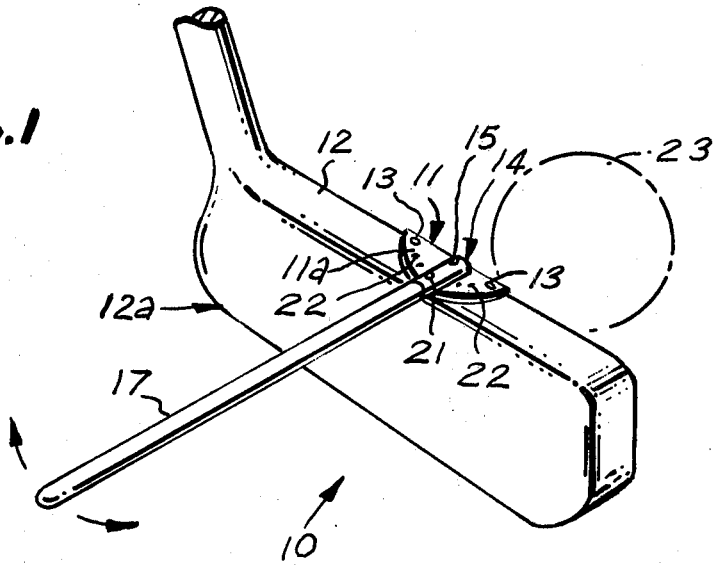
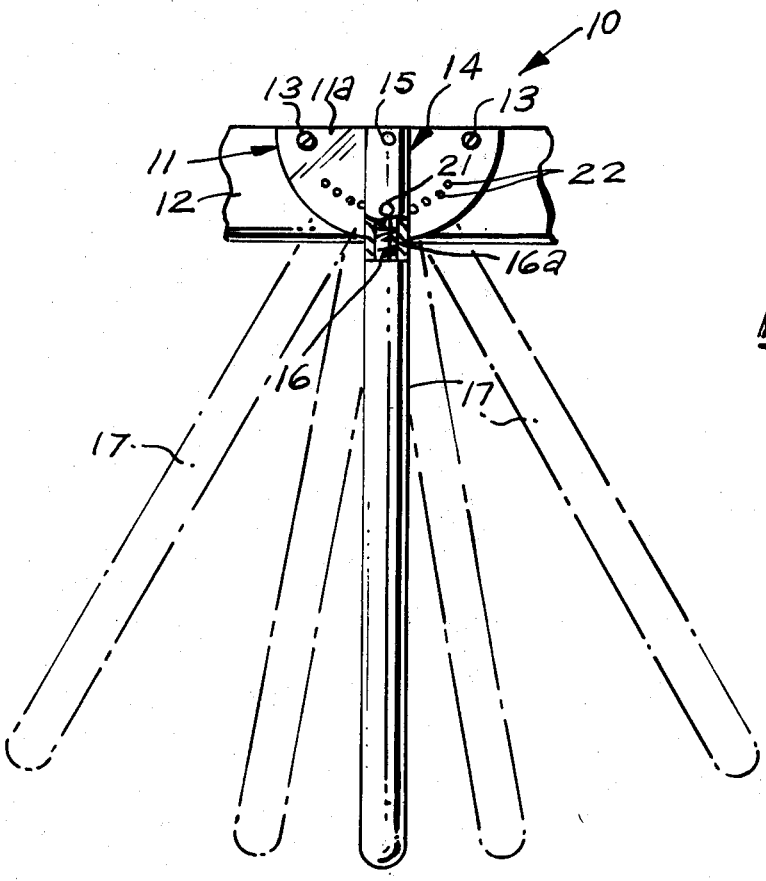
FIG. 2
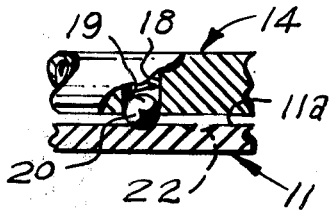
FIG. 3

ADJUSTABLE PUTTER BLADE SIGHT

This invention relates to golf club accessories, and more particularly, to an adjustable putter blade sight.

It is the principal object of this invention to provide an adjustable putter blade sight, which will be secured to the top of the putter blade, and which will enable the golfer, when getting set to make a "putt", to get behind his or her ball, and sight the "roll", or line from the ball to the hole.

Another object of this invention is to provide an adjustable putter blade sight, which will include a pivotal (white) sight rod, secured to a plate that will include a plurality of spaced-apart recesses, that are arranged in degrees of angle, for removably receiving a spring-loaded ball in the pivotal end of the sight rod, so as to enable the golfer to set the device to any desired angle. The aforementioned setting of the sight rod to any desired angle is because, in the prior art, when there was a slope in the turf, right or left, the golfer had to pick an imaginary aiming spot, to allow for the rolling trajectory of the ball to the hole. The present invention overcomes this problem, by enabling the golfer to be always putting at the hole, rather that at an imaginary spot.

Another object of this invention is to provide an adjustable putter blade sight, which will be adaptable for use by left handed golfers, as well as right handed golfers, and the length of the sight rod is such, that it will provide an excellent means of line-up, and it will be mounted square to the face of the putter blade.

A further object of this invention is to provide an adjustable putter blade sight, which will be used both on right hand and left hand "breaks", and the sight rod will be removable from its end, that is pivotally mounted to the plate, so as to prevent it from becoming bent, or otherwise damaged.

Other objects of the present invention are to provide an adjustable putter blade sight, which is simple in design, inexpensive to manufacture, rugged in construction, easy to use and efficient in operation.

These, and other objects, will be readily evident upon a study of the following specification and the accompanying drawing wherein:

FIG. 1 is a perspective view of the present invention, showing the golf club fragmentary, and a golf ball in phantom;

FIG. 2 is an enlarged fragmentary top plan view of FIG. 1, shown partly broken away, and illustrates various angular positions of the pointer or sighting rod of the device, in phantom, and FIG. 3 is a fragmentary side elevational view of the pointer or sighting rod of the device, illustrating the spring-loaded detent ball of the pivotal portion of the invention.

According to this invention, device 10 is shown to include a semi-circular plate 11, which is secured to the top surface 12 of putter blade 12*a*, by means of a pair of screw fasteners 13. A cylindrical member 14 is pivotally secured, at one end, to the top surface 11*a* of plate 11, by means of pivot pin 15. The threaded opening 16, in the opposite end of cylindrical member 14, removably receives the threaded shank 16*a* of one end of sight rod

17. Sight rod 17 is preferably metal, as is plate 11 and member 14, and is white in color, for providing excellent contrast with the ground or turf.

It shall be recognized, that sight rod 17 is removably received in cylindrical member 14, so as to prevent it from becoming bent or otherwise damaged, when not in use.

A transverse opening 18, in cylindrical member 14, receives a coil spring 19, which urges against a steel ball 20, at one end, and the opposite end of ball 20 urges against a plug 21, force fitted in member 14. Ball 20 is urged into any one of a plurality of radially spaced-apart recesses 22 in surface 11*a*, so as to provide detent means, for rendering sight rod 17 stationary at any desired degree of angle, when the user wants to "putt" ball 23 into the hole.

In use, when there is a right or left hand slope in the turf or ground, the golfer grasps the sight rod 17, and pivots it to alignment with any one of the recesses 22 in plate 11 desired, thus lining sight rod 17 up with the center of the hole, and when the aforementioned has been accomplished, the resulting trajectory of the ball 23 will carry it into the hole, after it is "putted".

While various changes may be made in the detail construction, it is understood that such changes will be within the spirit and scope of the present invention, as is defined by the appended claims.

What we now claim is:

1. An adjustable putter blade sight, comprising, in combination, a mounting plate, secured to the top surface of the blade of a golf club, a cylindrical member pivotally secured, at one end, to said mounting plate, a spring and a ball secured in said cylindrical member, providing detent means for rendering said cylindrical member stationary at various degrees on said mounting plate, and a sight rod, removably received in said cylindrical member; said mounting plate being secured to the top surface of said blade of said gold club by suitable screw fasteners, one at each end, adjacent to the striking face of said blade of said golf club, and one end of said cylindrical member is secured, by a transverse pivot pin, to said mounting plate, adjacent to said striking face of said blade of said golf club, and said transverse pivot pin is fixedly secured in said top surface of said mounting plate; and said ball and spring being freely received in a transverse opening through said cylindrical member, spaced apart from said transverse pivot pin, and said spring urges against a plug fixedly secured in one end of the opening receiving said ball and spring, and the opposite end of said spring urges said ball into any one of a plurality of radially spaced-apart recesses included in the top surface of said mounting plate, the recesses providing the means of adjusting said cylindrical member to any desired angle with respect to said striking face of said blade of said golf club.

2. The combination according to claim 1, wherein one end of said sight rod is externally threaded, and is threadingly received in the opposite end of said cylindrical member, and said sight rod extends rearwards from the rear face of said golf club, for the golfer to align it with the center of the hole that is to receive the ball being putted.

* * * * *